US007699215B2

(12) United States Patent
Spivey, Sr.

(10) Patent No.: US 7,699,215 B2
(45) Date of Patent: Apr. 20, 2010

(54) GUSSETED CARTON

(75) Inventor: Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 534 days.

(21) Appl. No.: 11/345,185

(22) Filed: Feb. 1, 2006

(65) Prior Publication Data

US 2006/0169755 A1 Aug. 3, 2006

Related U.S. Application Data

(60) Provisional application No. 60/649,351, filed on Feb. 1, 2005.

(51) Int. Cl.

| | |
|---|---|
| ***B65D 5/46*** | (2006.01) |
| ***B65D 5/00*** | (2006.01) |
| ***B65D 17/00*** | (2006.01) |
| ***B65D 65/00*** | (2006.01) |
| ***B65D 75/00*** | (2006.01) |

(52) U.S. Cl. ..... 229/240; 229/117.16; 229/109; 229/243; 206/427

(58) Field of Classification Search ..... 229/240, 229/117.16, 109, 243; 206/427
See application file for complete search history.

(56) References Cited

U.S. PATENT DOCUMENTS

| | | | | | |
|---|---|---|---|---|---|
| 2,594,376 | A | | 4/1952 | Arneson | |
| 2,810,506 | A | * | 10/1957 | Kessler | 229/117.12 |
| 2,844,299 | A | * | 7/1958 | Kessler et al. | 229/117.22 |
| 2,868,433 | A | | 1/1959 | Anderson, Jr. | |
| 2,955,739 | A | | 10/1960 | Collura | |
| 3,112,856 | A | | 12/1963 | MacIntosh et al. | |
| 3,127,720 | A | | 4/1964 | Gentry et al. | |
| 3,204,814 | A | | 9/1965 | Mahon | |
| 3,355,089 | A | * | 11/1967 | Champlin | 229/243 |
| 3,974,658 | A | * | 8/1976 | Starrett | 62/60 |
| 4,036,423 | A | | 7/1977 | Gordon | |
| 4,084,693 | A | * | 4/1978 | Culpepper | 206/427 |
| 4,216,861 | A | | 8/1980 | Oliff | |
| 4,328,923 | A | * | 5/1982 | Graser | 229/101 |
| 4,378,905 | A | | 4/1983 | Roccaforte | |
| 4,498,619 | A | | 2/1985 | Roccaforte | |
| 4,546,914 | A | | 10/1985 | Roccaforte | |
| 4,577,799 | A | | 3/1986 | Oliff | |
| 4,588,084 | A | | 5/1986 | Holley | |
| 4,747,487 | A | | 5/1988 | Wood | |
| 4,967,901 | A | * | 11/1990 | Wood | 206/139 |
| 5,020,337 | A | | 6/1991 | Krieg | |
| 5,072,876 | A | * | 12/1991 | Wilson | 229/103.2 |
| 5,197,598 | A | | 3/1993 | Stout et al. | |
| 5,246,112 | A | * | 9/1993 | Stout et al. | 206/427 |

(Continued)

FOREIGN PATENT DOCUMENTS

| | | |
|---|---|---|
| AT | 357933 | 8/1980 |

(Continued)

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A carton includes a bottom receptacle defined in part by the bottom panel, the side panels, and gusseted end panels. The bottom receptacle can be constructed without glue seals so that the receptacle is liquid-tight.

20 Claims, 4 Drawing Sheets

U.S. PATENT DOCUMENTS

| | | | | | |
|---|---|---|---|---|---|
| 5,292,058 | A | | 3/1994 | Zoss et al. | |
| 5,303,863 | A | * | 4/1994 | Arasim | 229/227 |
| 5,427,241 | A | * | 6/1995 | Sutherland | 206/427 |
| 5,482,203 | A | * | 1/1996 | Stout | 229/117.13 |
| 5,495,727 | A | * | 3/1996 | Strong et al. | 62/529 |
| 5,551,556 | A | | 9/1996 | Sutherland | |
| 5,582,343 | A | * | 12/1996 | Dalvey | 229/101 |
| 5,639,017 | A | | 6/1997 | Fogle | |
| 5,704,470 | A | * | 1/1998 | Sutherland | 206/147 |
| 5,794,778 | A | | 8/1998 | Harris | |
| 5,826,782 | A | | 10/1998 | Stout | |
| 5,873,515 | A | | 2/1999 | Dunn et al. | |
| 5,915,546 | A | | 6/1999 | Harrelson | |
| 5,992,733 | A | | 11/1999 | Gomes | |
| 6,065,590 | A | | 5/2000 | Spivey | |
| 6,085,969 | A | | 7/2000 | Burgoyne | |
| 6,164,526 | A | | 12/2000 | Dalvey | |
| 6,170,741 | B1 | | 1/2001 | Skolik et al. | |
| 6,227,367 | B1 | * | 5/2001 | Harrelson et al. | 206/427 |
| 6,302,320 | B1 | | 10/2001 | Stout | |
| D452,154 | S | * | 12/2001 | Rhodes et al. | D9/432 |
| 6,371,365 | B1 | * | 4/2002 | Doucette et al. | 229/120.011 |
| 6,631,803 | B2 | * | 10/2003 | Rhodes et al. | 206/427 |
| 6,758,337 | B2 | | 7/2004 | Chargueraud et al. | |
| 6,926,193 | B2 | | 8/2005 | Smalley | |
| 6,945,450 | B2 | * | 9/2005 | Rusnock | 229/243 |
| 7,234,596 | B2 | * | 6/2007 | Lebras | 206/427 |
| 7,296,731 | B2 | * | 11/2007 | Auclair et al. | 229/242 |
| 2006/0273143 | A1 | | 12/2006 | Finch | |
| 2007/0051781 | A1 | | 3/2007 | Holley, Jr. | |

FOREIGN PATENT DOCUMENTS

| | | |
|---|---|---|
| CA | 2 160 145 | 9/1995 |
| DE | 2655591 | 6/1978 |
| DE | 202 06 426 U1 | 9/2002 |
| DE | 20206426 U1 | 10/2002 |
| GB | 1395644 | 5/1975 |
| WO | 9403374 | 2/1994 |
| WO | WO 2007/089282 | 8/2007 |

* cited by examiner

GUSSETED CARTON

RELATED APPLICATION

This application claims the benefit of U.S. Provisional Application Ser. No. 60/649,351, entitled "GUSSETED CARTON," filed Feb. 1, 2005, the entire contents of which are hereby incorporated by reference as if presented herein in its entirety.

BACKGROUND

1. Technical Field

The technical field relates to blanks and constructs foldably formed therefrom, and, more particularly, to dispensing cartons for accommodating containers.

2. Related Art

Dispensing cartons are known. Conventional dispensing cartons may have a top panel with a dispensing feature formed therein. Such cartons may be used to contain articles such as beverage containers that are dispensable through the top panel or another panel when the carton is opened. Typically, the cartons must be refrigerated in order to keep the enclosed containers cool. When the cartons are no longer refrigerated, such as when the carton is removed from the refrigerator to dispense the containers, the containers may become undesirably warm. The containers must then be refrigerated again or otherwise cooled.

SUMMARY

According to a first exemplary embodiment of the invention, a carton comprises a top panel, a bottom panel, a first side panel, a second side panel, a first gusseted end panel, and a second gusseted end panel. A bottom receptacle of the carton may be defined in part by the bottom panel, the side panels, and the gusseted end panels. The carton may accommodate one or more articles, such as, for example, beverage containers.

According to an aspect of the first embodiment, the bottom receptacle can be constructed to have a height that extends above the bottom panel below which there are no seams sealed by glue or other adhesives. The bottom receptacle may therefore be liquid-tight. In one application, the carton may be opened at a dispenser pattern and ice can be placed in the carton along with the containers. As the ice melts, the water runoff from the ice is retained in the bottom receptacle.

According to another aspect of the invention, if an article accommodated within the carton breaks or ruptures during transport or storage of the carton, the bottom receptacle may serve to retain all or a part of the container contents.

Other aspects, features, and details of the present invention can be more completely understood by reference to the following detailed description, taken in conjunction with the drawings and from the appended claims.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

DETAILED DESCRIPTION

The first embodiment of the present invention generally relates to a carton suitable for storing and dispensing articles such as, for example, beverage containers. The carton provides a bottom receptacle suitable for accommodating, for example, liquids, ice, or other coolants in the carton bottom. In one exemplary embodiment, ice can be added to the opened carton to cool articles held within the carton. As the ice melts, all or a part of the resultant runoff water is held within the bottom receptacle.

Articles accommodated within the present carton embodiments can include containers such as, for example, petaloid bottle containers, beverage cans, glass or plastic bottles, or other containers such as, for example, those used in packaging foodstuffs. For the purposes of illustration and not for the purpose of limiting the scope of the invention, the following detailed description describes bottle beverage containers as disposed within the carton embodiments. In this specification, the terms "lower," "upper" and "top" indicate orientations determined in relation to fully erected, upright cartons.

Figure 1:
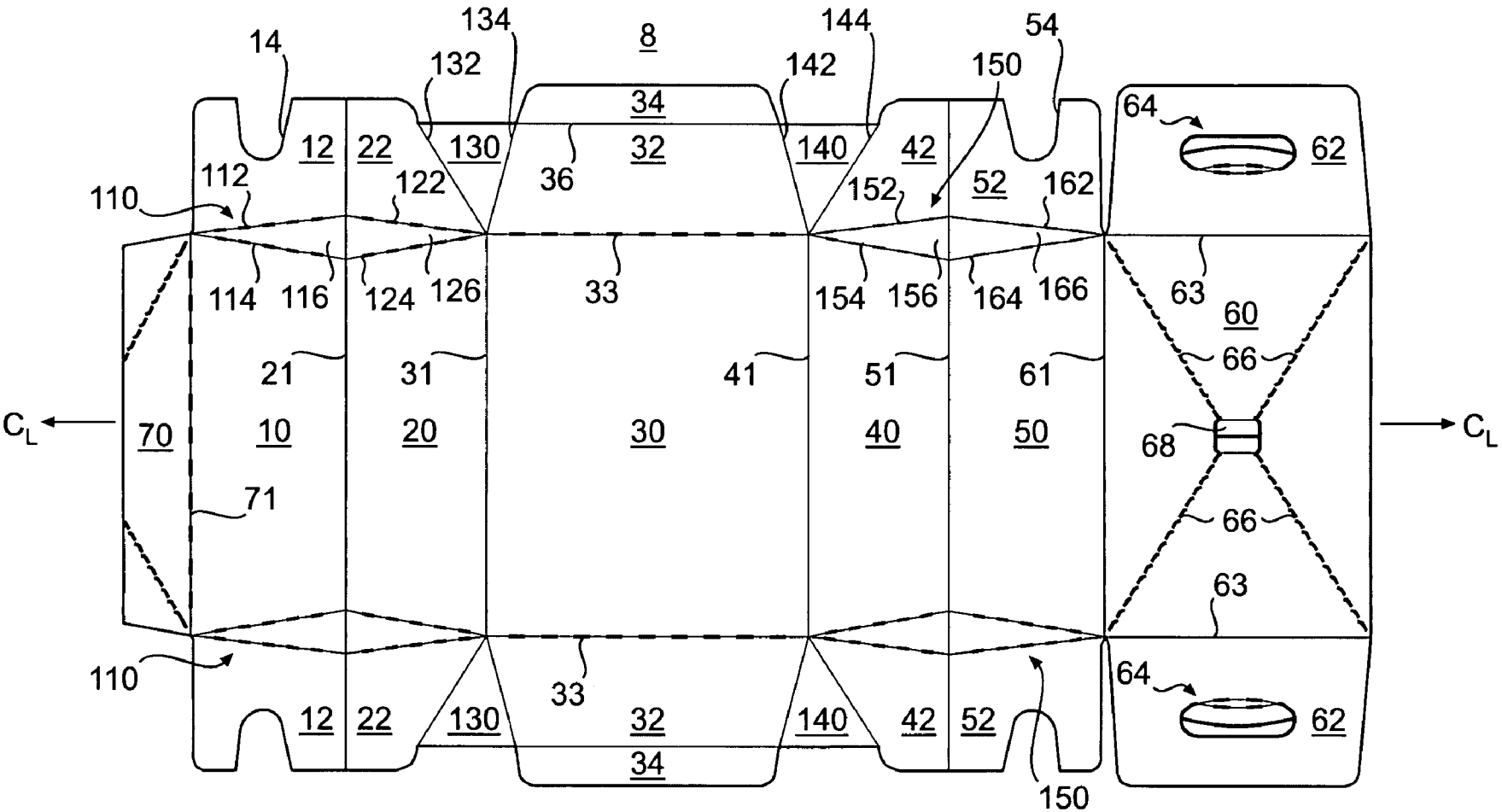
FIG. 1 is a plan view of a blank used to form a carton according to a first embodiment of the invention.

FIG. 1 is a plan view of a blank 8 used to form the carton or carrier 160 according to the first embodiment of the invention. The carton 160, when loaded with containers C, forms a package 190 (illustrated in FIG. 4). As shown in FIG. 1, the blank 8 may be symmetric or nearly symmetric about a longitudinal centerline $C_L$. Therefore, certain elements in the drawing figures may have identical or similar reference numerals in order to reflect partial or complete longitudinal symmetry in the blank.

The blank 8 comprises a first upper side panel 10 foldably connected to a first lower side panel 20 at a first transverse fold line 21, a bottom panel 30 foldably connected to the first lower side panel 20 at a second transverse fold line 31, a second lower side panel 40 foldably connected to the bottom panel 30 at a third transverse fold line 41, a second upper side panel 50 foldably connected to the second lower side panel 40 at a fourth transverse fold line 51, and a top panel 60 foldably connected to the second upper side panel 50 at a fifth transverse fold line 61. An adhesive panel 70 can be foldably connected to the first upper side panel 10 at a sixth transverse fold line 71.

First diamond corners 110 are disposed on either end of the first upper and lower side panels 10, 20. The first diamond corners 110 comprise a pair of triangular panels 116, 126 that are defined in part by oblique fold lines 112, 122, 114, 124. Upper side end panels 12 are foldably connected to the diamond corners 110 at the oblique fold lines 112, and lower side end panels 22 are foldably connected to the diamond corners 110 at the oblique fold lines 122. Second diamond corners 150 are disposed on either side of the second upper and lower side panels 50, 40. The second diamond corners 150 comprise a pair of triangular panels 156, 166 that are defined in part by oblique fold line 152, 162, 154, 164. Upper side end panels 52 are foldably connected to the second diamond corners 150 at the oblique fold lines 162, and lower side end panels 42 are foldably connected to the diamond corners 150 at the oblique fold lines 152.

Figure 4:
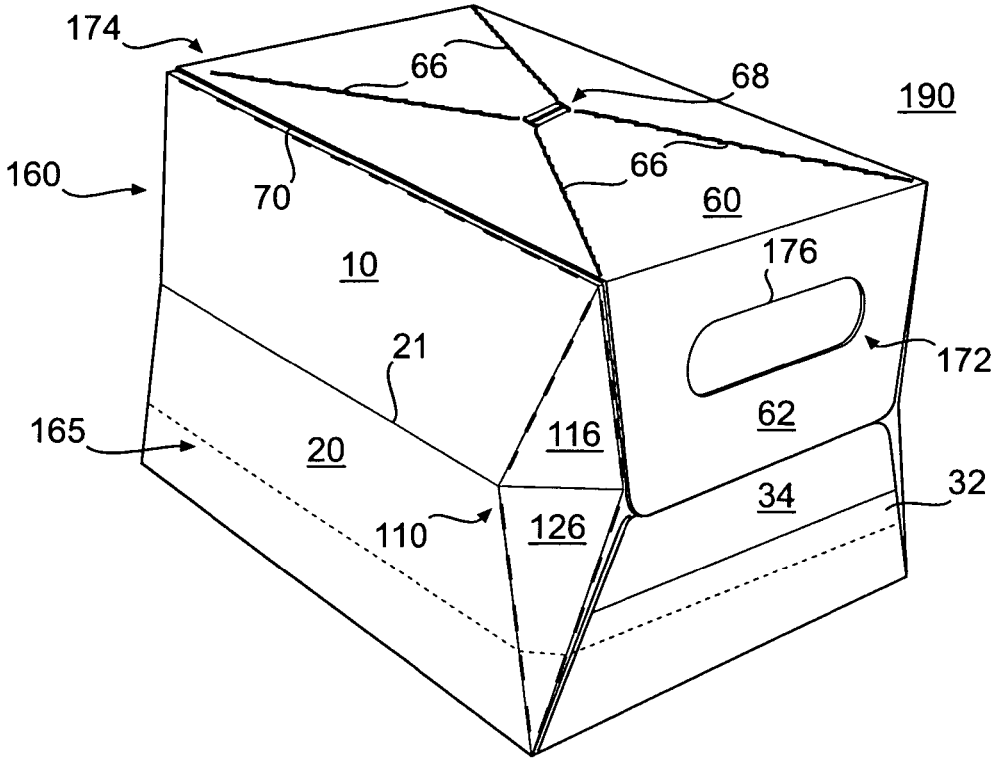
FIG. 4 is a perspective view of the erected carton with containers accommodated therein.

The top panel 60 can include a pattern of a plurality of tear lines 66 that allow the top panel 60 to be opened for dispensing of articles from the carton 160 (illustrated in FIG. 4). A finger or access aperture 68 can also be provided in the top panel 60 to serve as a starting point for opening the top panel 60. The pattern of tear lines 66 is arranged obliquely in a general "X" pattern in FIG. 1, although other patterns of tear lines, cut lines, and/or other lines of disruption for forming an opening pattern are suitable. Top end panels 62 are foldably connected to each end of the top panel 60 at longitudinal fold lines 63. Each top end panel 62 may include, for example, a handle aperture 64. The first and second upper side end panels 12, 52 may include handle cutouts 14, 54, respectively. The handle cutouts 14, 54 may generally conform in contour to the shape of the handle apertures 64 in the handle top end panels 62.

According to one exemplary aspect of the invention, bottom end panels 32 are disposed at either end of the bottom panel 30, and triangular gusset panels 130, 140 extend from opposite sides of the bottom end panels 32. The gusset panels 130, 140 in part form a wholly or partially liquid-tight bottom receptacle 165 (illustrated in FIG. 4) in the erected carton 160. The bottom end panels 32 are foldably connected to the bottom panel 30 along longitudinal fold lines 33. The gusset panels 130 are foldably connected to the lower side end panels 22 along oblique fold lines 132, and to the bottom end panels 32 along oblique fold lines 134. The gusset panels 140 are foldably connected to the opposite side of the bottom end panels 32 along oblique fold lines 142, and to the lower side end panels 42 along oblique fold lines 144. An adhesive panel 34 may be foldably connected to each bottom end panel 32 along a longitudinal fold line 36, and the fold line 36 may be, for example, collinear with exterior edges of the gusset panels 130, 140. The panels 12, 22, 130, 32, 34, 140, 42, 52, 62 generally extend along a first marginal area (the upper region or area in FIG. 1) of the blank 8, and along a second marginal area (the lower region or area in FIG. 1) of the blank 8.

Figure 2:
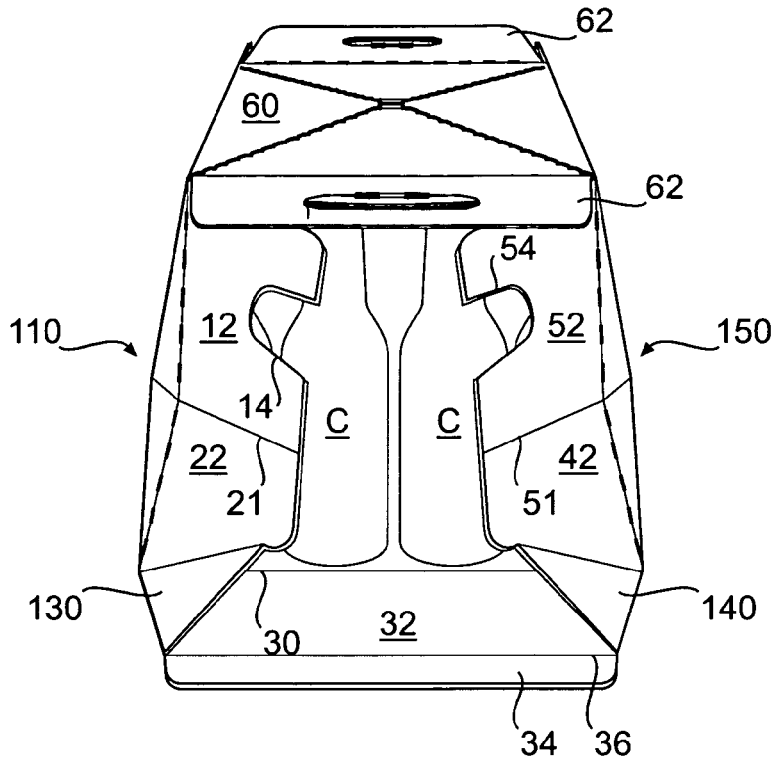
FIG. 2 is an end perspective view of the carton in a partially erected state.

An exemplary method of erection of the blank 8 into the carton 160 will now be discussed with reference to FIGS. 2 and 3. FIG. 2 illustrates the carton 160 in a partially erected state, with one end partially closed. In FIG. 2, the blank 8 has been folded and the adhesive panel 70 (not shown) has been adhered to an interior side of the top panel 60. The blank 8 is opened to form a generally tubular shape. The side end panels 12, 22, 42, 52 are partially folded inwardly at the diamond corners 110, 150. As the side end panels 12, 22, 42, 52 are folded inwardly, the gusset panels 130, 140 are also pulled inwardly.

Figure 3:
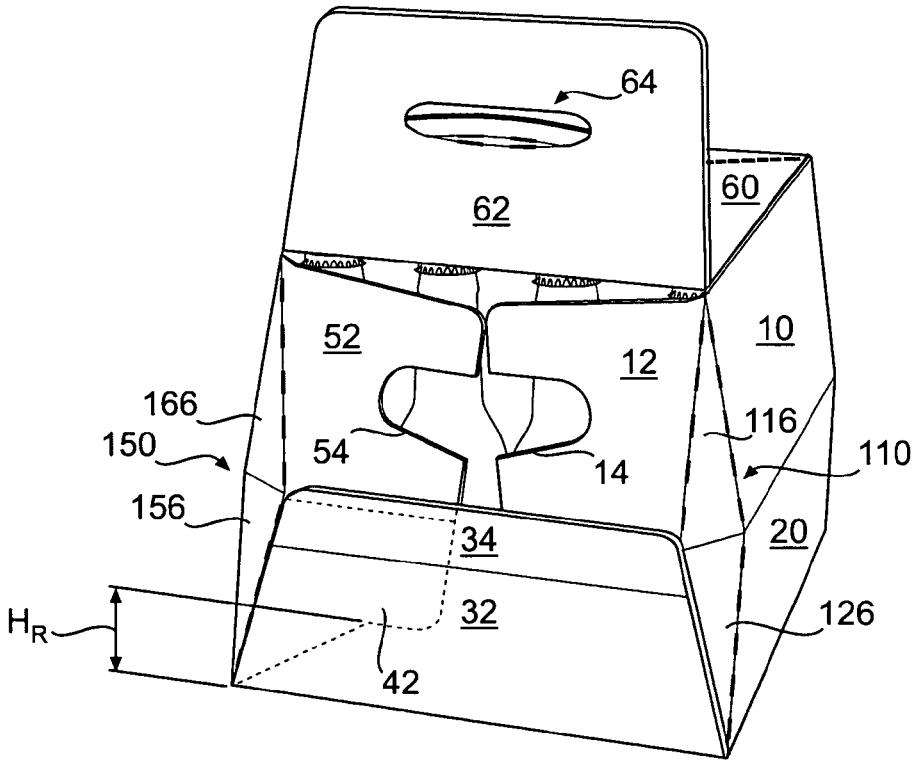
FIG. 3 is a perspective view of the opposite end of the carton in a partially erected state.

FIG. 3 illustrates the opposite end of the carton being closed, where the bottom end panels 32 are folded upwardly so that the panels 32, 34 come into contact and overlap with the exterior of the side end panels 12, 22, 42, 52. The panels 32, 34 may be, for example, adhesively attached to any or all of the side end panels 12, 22, 42, 52 at one or more locations. As the panels 32, 34 are folded upwardly, the gusset panels 130, 140 also fold inwardly and overlap the lower side end panels 22, 42, respectively. The gusset panels 130, 140 may be, for example, adhesively attached to the lower side end panels 22, 42 at one or more locations. In FIG. 3, the lower side end panel 42 is indicated by hidden lines, as will be discussed below. The top end flap 62 is folded down to contact the upper side end panels 12, 52 and is adhered thereto.

FIG. 4 illustrates the erected carton 160. Containers C or other articles or materials can be loaded into the partially formed carton 160 at any time before closing both ends of the carton 160. The carton 160 with containers C accommodated therein forms a package 190. Referring also to FIG. 1, the panels 12, 22, 32, 42, 52, 62, 130, 140 form a first end panel 172 at a first end of the carton 160, and a second end panel 174 at a second end of the carton. The handle apertures 64 and cutouts 14, 54 form handles 176 in the end panels 172, 174.

According to one aspect of the invention, the gusset panels 130, 140 may define in part an at least partially liquid-tight bottom receptacle 165 in the erected carton 160. The top edge or border of the bottom receptacle 165 is indicated by dashed lines in FIG. 4, and represents a portion of the bottom of the carton 160 below which no glued seals or seams are formed through which water or other liquid might leak. That is, in accordance with the first embodiment, no adhesive seal or other joiner of material where fluid might escape the carton 160 is located in the carton at a position below the top edge of the bottom receptacle 165. Referring also to FIG. 3, the bottom receptacle 165 may therefore be formed from a continuous section of folded material of the blank 8. The height of the liquid-tight portion of the receptacle 165 below which there are no glued seams is generally indicated as a height $H_R$ in FIGS. 3 and 4. Referring to FIG. 3, the height $H_R$ may generally coincide with an uppermost point where the gusset panel 140 is foldably connected to the lower side panel 42, as shown using hidden lines in FIG. 3, and the uppermost point at which the gusset panel 130 is foldably connected to the lower side panel 22 (not visible in FIG. 3).

The height $H_R$ may be, for example, defined as a function of a height of the carton 160. For example, referring to FIG. 4, the receptacle 165 may define a liquid-tight portion having a height $H_R$ that is at least about 5% of the height $H_C$ of the carton 160. In a carton accommodating beverage containers C, the height $H_R$ may be at least about ⅜ inches. In one embodiment, the height $H_R$ is about 1-⅛ inches. The height $H_R$ may be increased, for example, to accommodate larger anticipated liquid volumes in the carton 160.

Figure 5:
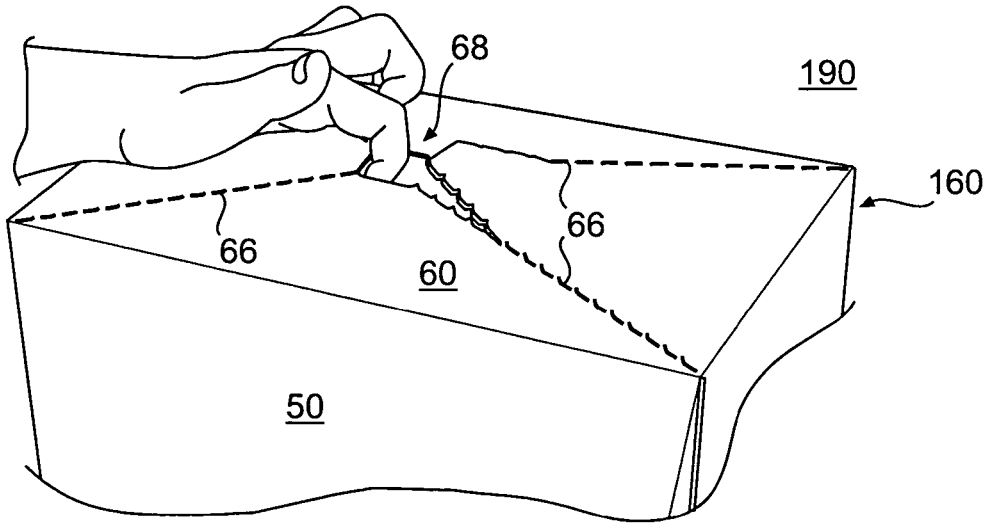
FIG. 5 illustrates a user opening the carton at the top panel.
Figure 6:
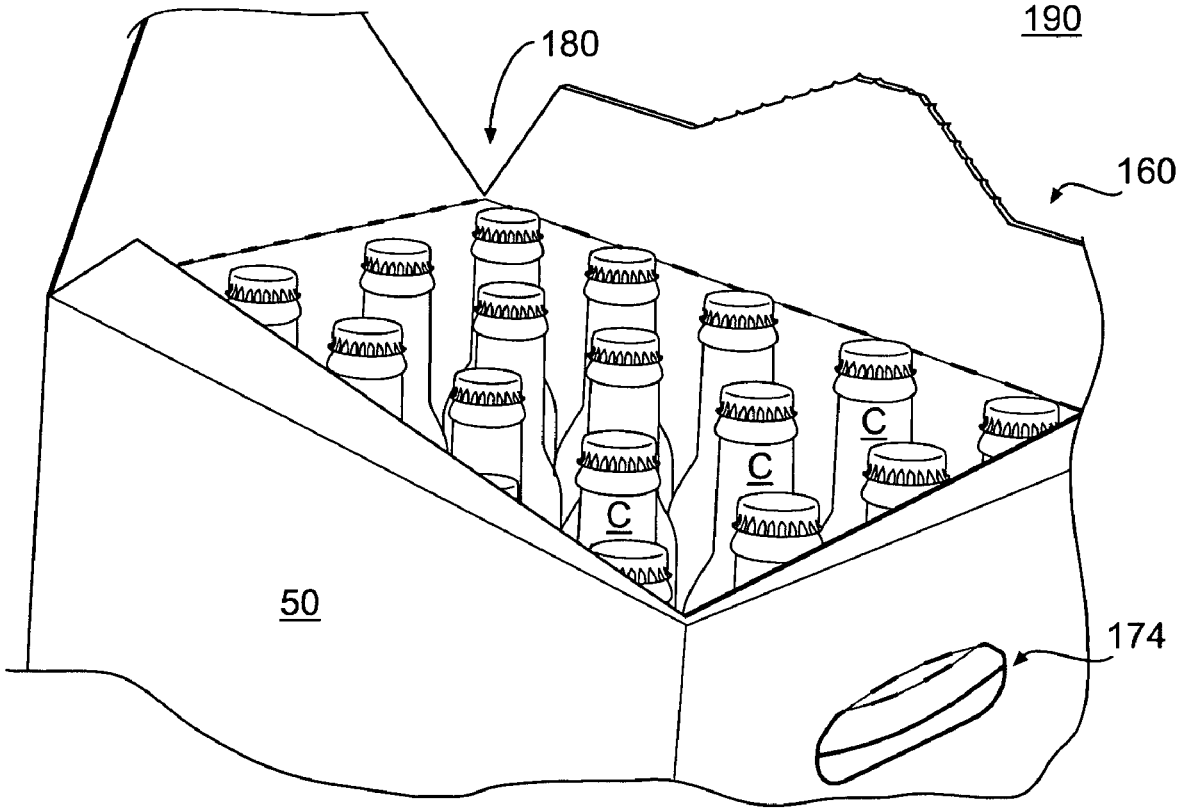
FIG. 6 illustrates the opened carton and containers accommodated within the carton.

FIGS. 5-6 illustrate the carton 160 being opened at the top panel 60. Referring to FIG. 5, the top panel 60 can be initially accessed at the access aperture 68. The top panel 60 can then be torn along one or more of the tear lines 66 to open the carton 160, as shown in FIG. 6. Opening the top panel 60 exposes the containers C for dispensing from an interior 180 the carton 160.

If desired, additional articles may be placed in the carton 160 after opening. For example, if the containers C are beverage containers, ice may be placed over the containers C and held within the carton interior 180 to cool the containers. As the ice melts, the receptacle 165 at the bottom of the carton 160 serves to retain all or a portion of the water runoff from the melting ice. The receptacle 165 may also serve, for example, to house fine particulate matter that might otherwise escape through a glued seam. If one or more containers C is damaged during shipping or storage of the carton 160, the bottom receptacle 165 can serve to retain all or a portion of the contents of the broken container.

The blank 8 can, for example, be constructed of water resistant material to any degree desired so that liquid in the bottom of the carton 160 remains in the bottom receptacle 165 for a selected amount of time. The carton 160 can therefore be constructed so that liquid retained in the bottom receptacle 165 initially remains in the carton 160 at least until it reached the height $H_R$.

Referring to FIGS. 3 and 4, the end panels 172, 174 of the carton 160 may be formed by selected gluing along the vertical extent of the side end panels 12, 22, 42, 52 so that an additional degree of water retention may be obtained above the height $H_R$.

Cartons according to the principles of the present invention may be formed from materials such as paperboard. Therefore, if exposed to water or other liquids for extended periods of time, the carton may allow for the passage of liquid through the wetted carton surfaces due to partial permeability of the carton material. In this specification, the term "liquid-tight" is generally used to define a section of a carton that is formed from a continuous section of material or of a section without any glued seams through which liquid or fine particulate matter might leak, and the term "liquid-tight" therefore encompasses cartons that may become partially water permeable over time.

In the above embodiments, the carton 160 is described as accommodating twenty 12-ounce bottle containers C in 4×5 configuration. Other arrangements of containers, packages, articles, and other items, however, can be accommodated within a carton according to the principles of the present invention. For example, a carton constructed according to the principles of the present invention would also work satisfactorily if the carton were sized and shaped to hold articles in other configurations, such as 3×4, 4×3, 3×6, 2×4, 2×5, etc. The dimensions of the blank 8 may also be altered, for example, to accommodate various container forms. For example, 16-ounce petaloid bottles may be accommodated within a carton constructed according to the principles of the present invention.

In the exemplary embodiments discussed above, the exemplary blanks may be formed from, for example, clay coated newsprint (CCN), solid unbleached sulfate board (SUS), and other materials. In general, the blanks may be constructed from paperboard having a caliper of at least about 14, for example, so that it is heavier and more rigid than ordinary paper. The blanks can also be constructed of other materials, such as cardboard, or any other material having properties suitable for enabling the carton to function at least generally as described above.

The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure paperboard carton panels in place.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding thereal-ong. More specifically, but not for the purpose of narrowing the scope of the present invention, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

In the illustrated embodiments, selected fold lines are shown as including spaced cuts to facilitate folding along the lines. If the cuts are below or adjacent to the bottom receptacle portion of the carton, less than 100% cuts may be used to prevent leakage along the fold lines. Alternatively, cuts or scores may be omitted within or near the receptacle portion.

In accordance with a second embodiment of the invention, a tray, or other construct, is formed. As one example and referring to FIG. 1, the blank 8 can be modified by omitting the elements to the right of fold line 51 and omitting the flap 70. An open tray may be formed from the blank 8 modified in this manner.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton, comprising:

a top panel;

a bottom panel;

a first side panel comprising a first upper side panel and a first lower side panel;

a second side panel comprising a second upper side panel and a second lower side panel;

a first end panel, comprising:

a first bottom end panel foldably connected to the bottom panel at a longitudinal fold line;

a first pair of gusset panels, the gusset panels being respectively foldably connected to opposite sides of the first bottom end panel;

a first pair of side end panels, one side end panel of the pair being foldably connected to one of the gusset panels, and the other side end panel of the pair being foldably connected to the other gusset panel, wherein the side end panels each comprise an upper side end panel and a lower side end panel; and a first pair of diamond corner panels, one diamond corner panel of the pair being respectively foldably connected to the first upper side panel at an oblique fold line that is oblique relative to the longitudinal fold line, to one of the upper side end panels, and to one of the lower side end panels, and the other diamond corner panel of the pair being respectively foldably connected to the second upper side panel at an oblique fold line that is oblique relative to longitudinal fold line, to the other upper side end panel, and to the other lower side end panel;

wherein the upper and lower side panels are respectively foldably connected by a continuous fold line, each continuous fold line extends substantially across a respective diamond corner panel and a respective side end panel, each continuous fold line foldably connects a respective upper side end panel and a respective lower side end panel; and a second end panel, wherein a bottom receptacle of the carton is defined at least in part by the bottom panel, the side panels, and the end panels, wherein the bottom panel comprises a bottom length extending transverse to the longitudinal fold line between respective ends of the bottom panel and the top panel comprises a top length extending transverse to the longitudinal fold line between respective ends of the top panel, the bottom length being equal to the top length such that an end of the bottom panel and an end of the top panel are in vertical alignment at a respective first end and a respective second end of the carton.

2. The carton of claim 1, wherein the bottom receptacle is a substantially liquid-tight receptacle that comprises a portion of the carton having an upper border below which no glued seams are formed.

3. The carton of claim 1, wherein the first upper side panel and the first lower side panel are respectively connected to one of the upper side end panels and one of the lower side end panels at oblique fold lines.

4. The carton of claim 1, wherein each gusset panel overlaps the bottom end panel and one of the side end panels.

5. The carton of claim 1, further comprising a second pair of diamond corner panels foldably connected to the second end panel.

6. The carton of claim 1 and a plurality of articles accommodated therein.

7. The carton of claim 1, further comprising a dispensing feature defined by one or more lines of disruption.

8. The carton of claim 1, wherein the bottom receptacle has a height of at least ⅜ inches.

9. The carton of claim 1, wherein the bottom receptacle comprises a portion of the carton having an upper border below which no glued seams are formed.

10. A carton blank, comprising:

a top panel;

a bottom panel;

a first side panel comprising a first upper side panel and a first lower side panel;

a second side panel comprising a second upper side panel and a second lower side panel;

a first plurality of panels extending along a first marginal area of the blank, the first plurality of panels comprising:

a first bottom end panel foldably connected to the bottom panel at a longitudinal fold line;

a first pair of gusset panels, the gusset panels being respectively foldably connected to opposite sides of the first bottom end panel;

a first pair of side end panels, one side end panel of the pair being foldably connected to one of the gusset panels, and the other side end panel of the pair being foldably connected to the other gusset panel, wherein each side end panel comprises an upper side end panel and a lower side end panel; and a first pair of diamond corner panels, one diamond corner panel of the pair being respectively foldably connected to the first upper side panel at an oblique fold line that is oblique relative to the longitudinal fold line, to one of the upper side end panels, and to one of the lower side end panels, and the other diamond corner panel of the pair being respectively foldably connected to the second upper side panel at an oblique fold line that is oblique relative to the longitudinal fold line, to the other upper side end panel, and to the other lower side end panel;

wherein the upper and lower side panels are respectively foldably connected by a continuous fold line, each continuous fold line extends substantially across a respective diamond corner panel and a respective side end panel, each continuous fold line foldably connects a respective upper side end panel and a respective lower side end panel; and a second plurality of panels extending along a second marginal area of the blank, wherein the bottom panel comprises a bottom length extending transverse to the longitudinal fold line between respective ends of the bottom panel, and the top panel comprises a top length extending transverse to the longitudinal fold line between respective ends of the top panel, the bottom length being equal to the top length.

11. The carton blank of claim 10, wherein, the at least one oblique fold line comprising a first oblique fold line foldably connecting the diamond corner panel to the first upper side panel and a second oblique fold line foldably connecting the diamond corner panel to the first lower side panel.

12. The carton blank of claim 10, further comprising a second pair of diamond corner panels extending along the second marginal area of the blank.

13. The carton blank of claim 11, wherein the gusset panels are triangular in shape.

14. The carton blank of claim 10, wherein the gusset panels are triangular in shape.

15. A carton blank for forming a substantially liquid-tight container, comprising:

a top panel;

a bottom panel;

a first side panel comprising:

a first upper side panel and a first lower side panel;

a second side panel comprising:

a second upper side panel and a second lower side panel;

a first plurality of panels extending along a first marginal area of the blank, the first plurality of panels comprising:

a first bottom end panel foldably connected to the bottom panel at a longitudinal fold line;

a first pair of triangular gusset panels, the first pair of gusset panels being respectively foldably connected to opposite sides of the first bottom end panel;

a first pair of upper side end panels; and a first pair of lower side end panels, one lower side end panel of the pair being foldably connected to one of the gusset panels, and the other lower side end panel of the pair being foldably connected to the other gusset panel;

a first pair of diamond corner panels, one diamond corner panel of the pair being respectively foldably connected to the first upper side panel at an oblique fold line that is oblique relative to the longitudinal fold line, to one of the upper side end panels, and to one of the lower side end panels, and the other diamond corner panel of the pair being foldably connected to the second upper side panel at an oblique fold line that is oblique relative to the longitudinal fold line, to the other upper side end panel, and to the other lower side end panel;

wherein the upper and lower side panels are respectively foldably connected by a continuous fold line, each continuous fold line extends substantially across a respective diamond corner panel and a respective side end panel, each continuous fold line foldably connects a respective upper side end panel and a respective lower side end panel;

a second plurality of panels extending along a second marginal area of the blank; and at least one breachable dispenser pattern, wherein the bottom panel comprises a bottom length extending transverse to the longitudinal fold line between respective ends of the bottom panel, and the top panel comprises a top length extending transverse to the longitudinal fold line between respective ends of the top panel, the bottom length being equal to the top length.

16. The carton blank of claim 15, further comprising a second pair of diamond corner panels extending along the second marginal area of the blank.

17. The carton of claim 1, wherein each diamond corner panel further comprises an upper triangular panel and a lower triangular panel, each upper triangular panel being foldably connected to one of the upper side end panels at respective oblique fold lines that are oblique relative to the longitudinal fold line, each lower triangular panel being foldably connected to one of the lower side end panels at respective oblique fold lines that are oblique relative to the longitudinal fold line, each first upper side panel and each first lower side panel are respectively connected to respective upper and lower triangular panels at respective oblique fold lines that are oblique relative to the longitudinal fold line, the oblique fold line respectively connecting each of the lower side panels to a respective lower triangular panel and the oblique fold line respectively connecting each of the lower side end panels to a respective lower triangular panel extend obliquely across a respective width of each lower side end panel and lower side panel to a respective corner of the bottom panel.

18. The carton blank of claim 15, wherein each diamond corner panel further comprises an upper triangular panel and a lower triangular panel, each upper triangular panel being foldably connected to one of the upper side end panels at respective oblique fold lines that are oblique relative to the longitudinal fold line, each lower triangular panel being foldably connected to one of the lower side end panels at respective oblique fold lines that are oblique relative to the longitudinal fold line, each first upper side panel and each first lower side panel are respectively connected to respective upper and lower triangular panels at respective oblique fold lines that are oblique relative to the longitudinal fold line, the oblique fold line respectively connecting each of the lower side panels to a respective lower triangular panel and the oblique fold line respectively connecting each of the lower side end panels to a respective lower triangular panel extend obliquely across a respective width of each lower side end panel and lower side panel substantially to a respective corner of the bottom panel.

19. The carton of claim 1, wherein each gusset panel of the first pair of gusset panels is connected to the first bottom end panel by a gusset fold line that is oblique relative to the longitudinal fold line.

20. The carton blank of claim 10, wherein each gusset panel of the first pair of gusset panels is connected to the first bottom end panel by a gusset fold line that is oblique relative to the longitudinal fold line.

* * * * *